US005511757A

United States Patent [19]

Freelander

[11] Patent Number: 5,511,757

[45] Date of Patent: Apr. 30, 1996

[54] PLATEN FOR STACKING WHEELED ARTICLES

[76] Inventor: Michael S. Freelander, 46 Whisper Dr., Worcester, Mass. 01609

[21] Appl. No.: 252,821

[22] Filed: Jun. 2, 1994

[51] Int. Cl.[6] ..... A47B 91/00

[52] U.S. Cl. ..... 248/346.03; 280/33.991

[58] Field of Search ..... 248/346.03; 280/33.998, 280/33.991, 33.992; 206/501; 220/23.6

[56] References Cited

U.S. PATENT DOCUMENTS

| | | | |
|---|---|---|---|
| 1,912,847 | 6/1933 | Klepel | 280/33.998 X |
| 3,160,292 | 12/1964 | Albrecht | 280/33.998 X |
| 3,305,117 | 2/1967 | Ford | 280/33.991 X |
| 3,953,047 | 4/1976 | Morgan | 280/33.998 X |
| 4,611,962 | 9/1986 | Braly | 280/33.998 X |
| 5,183,375 | 2/1993 | Fenton | 220/23.6 X |
| 5,299,816 | 4/1994 | Braucke | 280/33.998 |
| 5,322,306 | 6/1994 | Coleman | 280/33.991 X |

FOREIGN PATENT DOCUMENTS

| | | | |
|---|---|---|---|
| 2247447 | 4/1974 | Germany | 280/33.998 |

*Primary Examiner*—J. Franklin Foss
*Attorney, Agent, or Firm*—Salter & Michaelson

[57] ABSTRACT

A platen for stacking wheeled articles examples of which are toy shopping carts and comprises a bottom wall and two side portions joined to opposite sides of the bottom wall. The side portions include an outer flange which extends upwardly from the bottom wall, and an inside flange depending from the outside flange which extends downwardly in spaced relation to the outside flange thereby forming a spacing therebetween. The inside flange includes spaced slots in the lowermost edge thereof. A toy shopping cart is received on the bottom wall with its wheels adjacent the side portions. The inner flanges of the side portions are folded over the wheels of the cart so that the wheels are received in the spacing between the inner and outer flanges. The spaced slots on the lower edge of the inner flange engage with the hubs of the wheels. The bottom wall includes spaced slots in a rear edge thereof which are operable for receiving the handle of a second shopping cart when the platen is received on top of the basket of a second shopping cart.

9 Claims, 4 Drawing Sheets

PLATEN FOR STACKING WHEELED ARTICLES

BACKGROUND AND SUMMARY OF THE INVENTION

The instant invention relates to packaging materials, and more particularly to a platen for stacking wheeled articles on top of each other for storage and/or display.

The subject invention has particular application in the stacking of wheeled articles such as toy shopping carts, which are well known in the toy art. One of the problems that has been encountered by retail establishments that sell toy shopping carts is the display of the toy shopping carts in a confined area. Since the carts have wheels located at the bottom thereof, the carts tend to roll when placed on a floor or other display surface, and further there is no provision for normally locating one cart on top of another in stacked relation in order to display the carts in a relatively small area. One approach that has been taken by the retailers is to only display one floor model and to have customers request a sale model to be brought out from storage for purchase. This method of display however is not conducive to impulse sales because the customer must page a sales associate who must then retrieve a shopping cart from storage and deliver it to the customer.

The instant invention provides a platen which attaches to the wheels of the shopping cart to prevent movement of the cart on a flat surface and further to provide a flat stacking surface which can be received on top of the basket of another cart. The platen comprises a bottom wall and two side portions joined to opposite sides of the bottom wall. The side portions include an outer flange which extends upwardly from the bottom wall, and an inside flange depending from the outside flange which extends downwardly in spaced relation to the outside flange thereby forming a spacing therebetween. The inside flange includes spaced slots in the lowermost edge thereof. The toy shopping cart is received on the bottom wall of the platen with its wheels adjacent the side portions. The inner flanges of the side portions are folded over the wheels of the cart so that the wheels are received in the spacing between the inner and outer flanges. The spaced slots on the lower edge of the inner flange engage with the hubs of the wheels. The bottom wall includes spaced slots in a rear edge thereof which are operable for receiving the handlebars of a second shopping cart when the platen is received on top of the basket of a second shopping cart.

Accordingly, it is an object of the instant invention to provide a platen for preventing the movement of a wheeled vehicle on flat surface.

It is another object to provide a platen for stacking wheeled vehicles one on top of another.

It is still another object to provide a platen for stacking toy shopping carts on top of each other.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
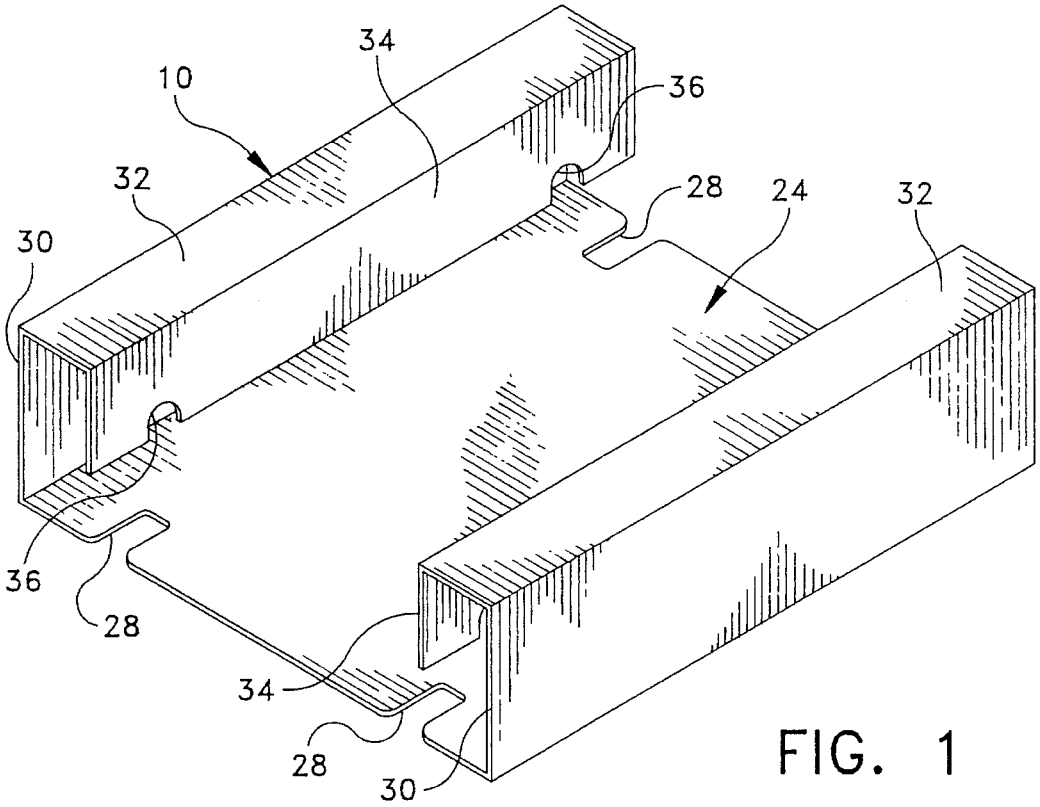
FIG. 1 is a perspective view of the platen of the instant invention.

Referring now to the drawings, the platen of the instant invention is illustrated and generally indicated at 10 in FIGS. 1–6. As will hereinafter be more fully described, the instant platen 10, which can be utilized to stack various kinds of wheeled articles, is received over the wheels of a toy shopping cart generally indicated at 12 to prevent movement of the cart 12 on a flat surface, and further to provide a flat stacking surface so that one shopping cart 12 can be received on top of another. The shopping cart 12 comprises a basket generally indicated at 14 having a flat flange 16 at an upper edge thereof, a handle generally indicated at 18 extending upwardly from the basket 14, a basket frame 20 and a plurality of wheels 22 at the lowermost portion of the basket frame 20 for rotatably supporting the basket 14 on a supporting surface.

The platen 10 is preferably fashioned from a stiff paperboard material, such as cardboard, and it comprises a bottom wall generally indicated at 24 and two side portions generally indicated at 26 joined to opposite sides of the bottom wall 24. The bottom wall 24 and side portions 26 are preferably struck as an integral unit from a flat sheet of material. The bottom wall 24 includes a pair of spaced slots 28 in both the front and rear edges thereof. The side portions 26 comprise an outside flange 30 which extends upwardly from the bottom wall 24, an upper flange portion 32, and an inner flange 34 which extends downwardly from the upper flange portion 32 in spaced relation to the outer flange 30 thereby forming a spacing therebetween. The inner flange 34 includes a pair of spaced slots 36 in the lowermost edge thereof.

Figure 2:
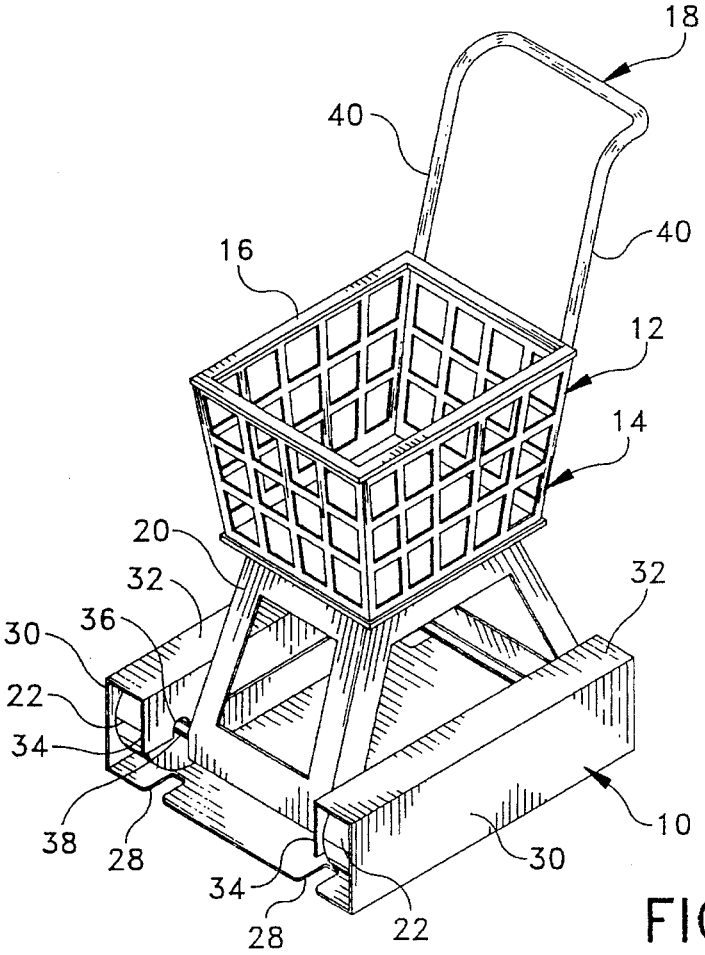
FIG. 2 is another perspective view of the platen assembled with a toy shopping cart.
Figure 3:
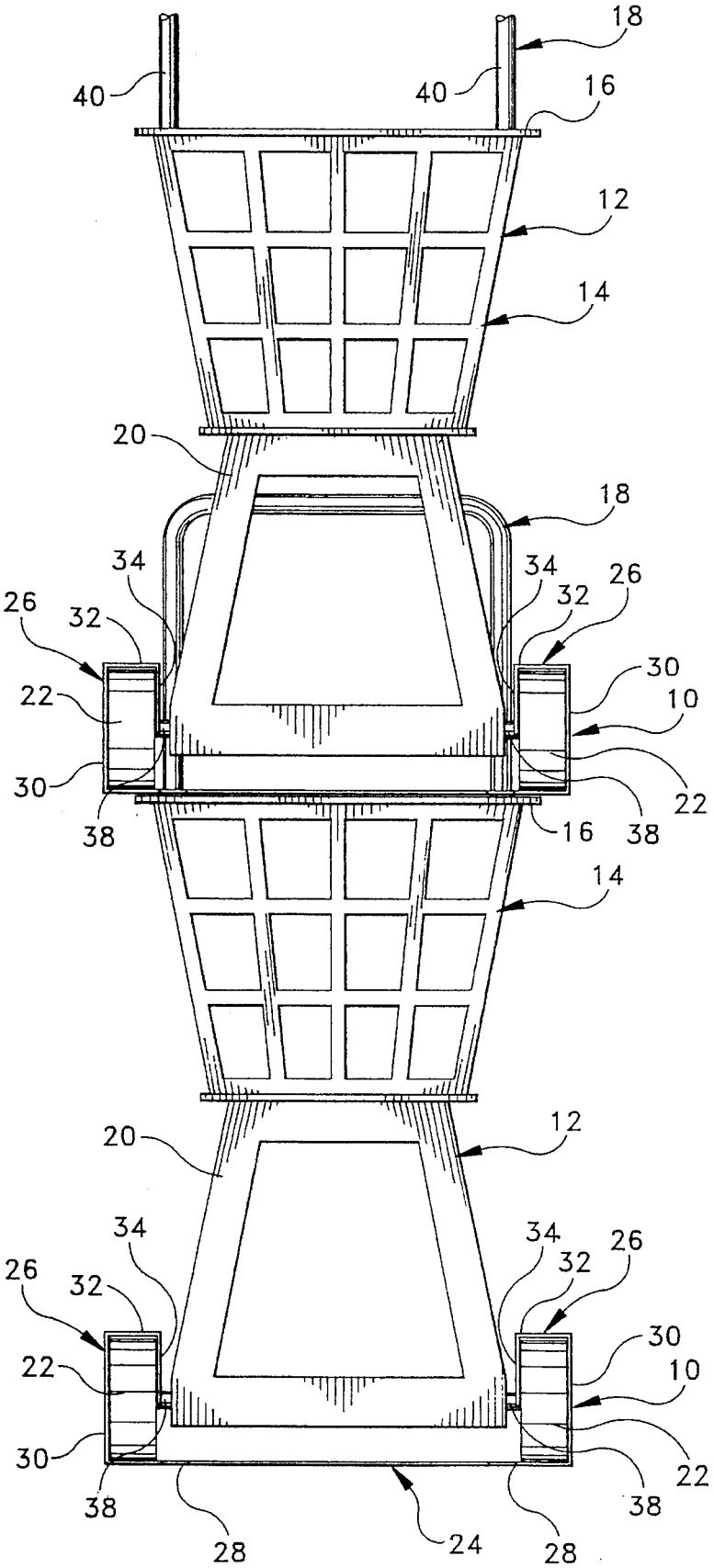
FIG. 3 is a front view of two toy shopping carts stacked one on top of another.
Figure 4:
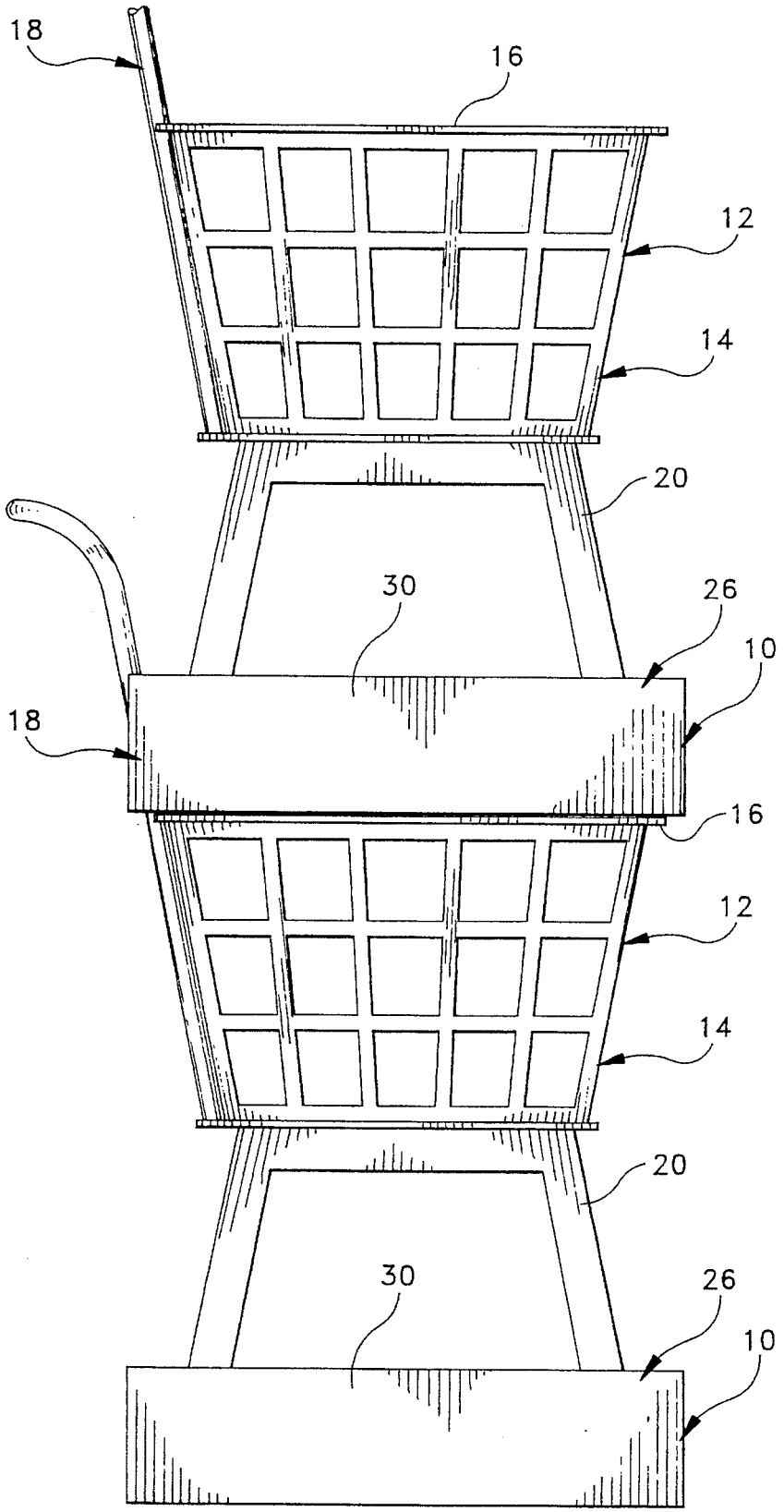
FIG. 4 is a side view thereof.
Figure 5:
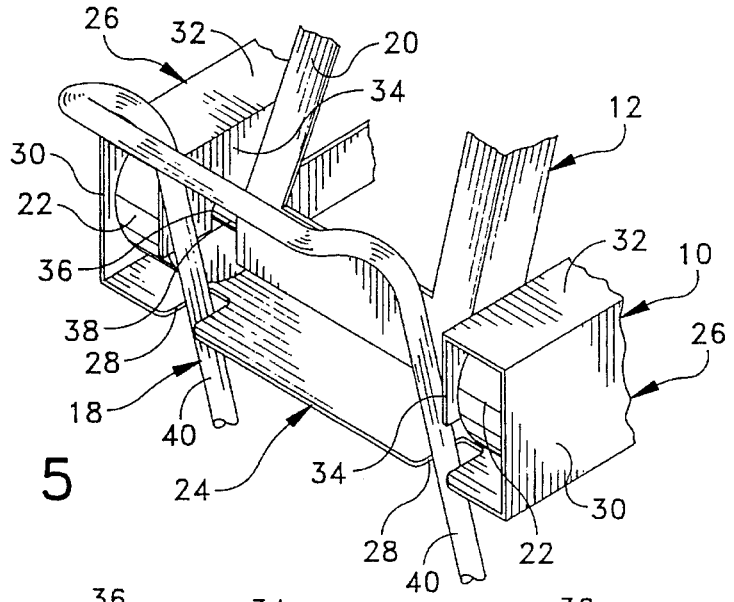
FIG. 5 is an enlarged perspective view, partially broken away, showing the handlebars of a shopping cart received into slots in the bottom wall of the platen.
Figure 6:
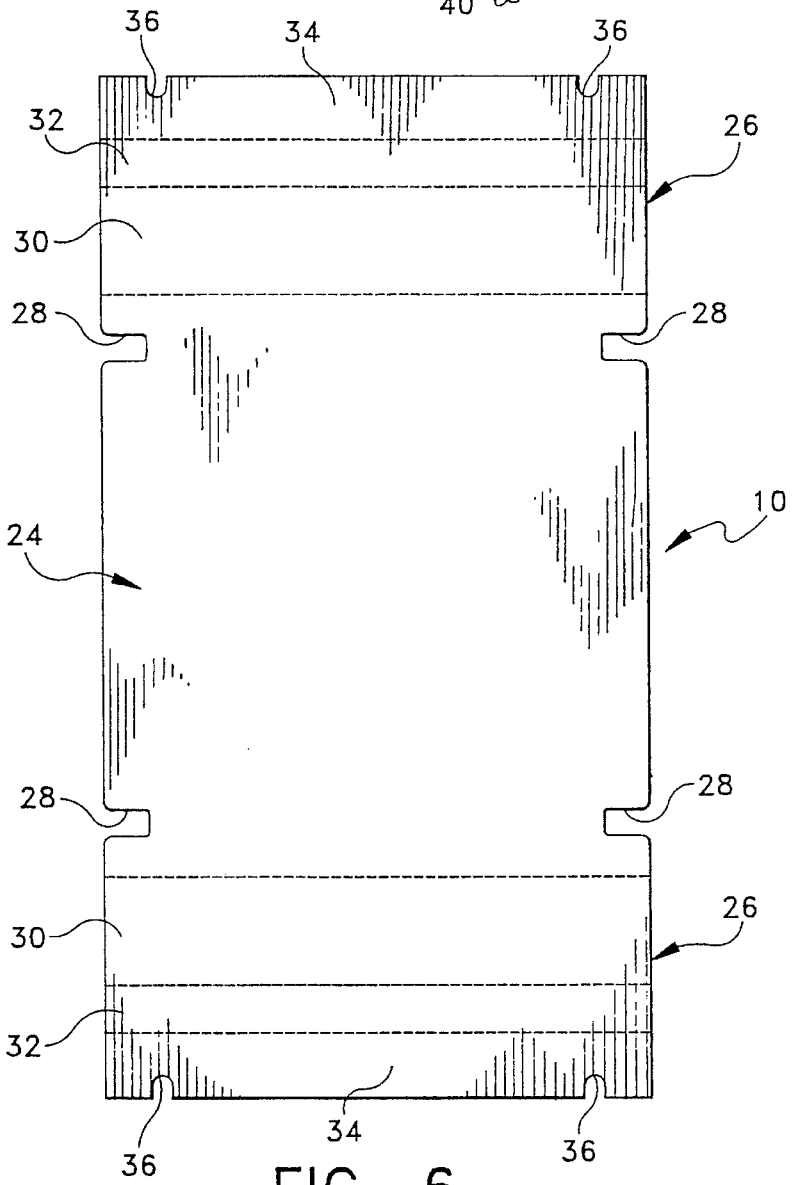
FIG. 6 illustrates the platen in blank form.

In use, the wheels 22 of the shopping cart 12 are received on the bottom wall 24 of the platen 10 with the wheels 22 adjacent the side portions 26. The upper flange portion 32 and inside flange 34 are folded over the tops of the wheels 22, as illustrated in FIGS. 2 and 3, so that the wheels 22 are received in the spacing between the outer and inner flanges 30 and 36 respectively. The spaced slots 36 in the lowermost edge of the inner flange 34 are received over the hubs, or axles 38, of the wheels 22 to lock the platen 10 in position with respect to the wheels 22. Accordingly, when the shopping cart 12 is placed on a flat supporting surface with the platen 10 attached thereto, the wheels 22 are immobilized thereby preventing the shopping cart 12 from rolling. The bottom wall 24 of the platen 10 further provides a flat stacking surface for stacking one shopping cart 12 on top of another. In this connection, when the bottom wall 24 of the platen 10 is received onto the flat upper flange 16 of the basket 14 of a second shopping cart 12 located thereunder (See FIGS. 3 and 4), the platen 10 is located in a substantially horizontal position to maintain the upper toy shopping cart 12 mounted thereon in an erect position. The platen 10 is maintained in a fixed position on the basket 14 of the lower cart 12 by inserting the spaced arm portions 40 of the handle 18 into the spaced slots 28 in the rear edge of the bottom wall 24 (FIG. 5). The slots 28 are provided in both the front and rear edges so that the platen 10 is fully reversible.

While the platen 10 is hereinabove described for use in connection with a toy shopping cart 12, it is to be understood that the instant platen 10 is operable for use with virtually any wheeled vehicle or article for the purposes of displaying wheeled articles in stacked relation.

It can therefore be seen that the instant invention provides an effective stacking platen 10 for toy shopping carts 12, or other wheeled vehicles. The platen 10 prevents the cart 12 from rolling when placed on a flat surface and further provides a flat stacking surface for supporting a plurality of carts 12 in stacked relation. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A platen for stacking a wheeled article comprising a bottom wall, and two side portions joined to opposite sides of said bottom wall, said side portions including an outer flange which extends upwardly from said bottom wall, and an inside flange depending from said outside flange which extends downwardly in spaced relation to said outside flange thereby forming a spacing therebetween, said inside flange including spaced slots in the lowermost edge thereof, said wheeled article being received on said bottom wall between said side portions, said side portions being folded over the wheels of said article so that said wheels are received in said spacing, said spaced slots in said inner flange engaging with the hubs of said wheels.

2. In the platen of claim 1, said bottom wall including spaced slots in a rear edge thereof.

3. A platen for stacking a toy shopping cart comprising a basket, handle means extending upwardly and rearwardly from said basket, and a plurality of wheels for rotatably supporting said basket on a supporting surface, said platen comprising a bottom wall, and two side portions joined to opposite sides of said bottom wall, said side portions including an outer flange which extends upwardly from said bottom wall, and an inside flange depending from said outside flange which extends downwardly in spaced relation to said outside flange thereby forming a spacing therebetween, said inside flange including spaced slots in the lowermost edge thereof, said toy shopping cart being received on said bottom wall with said wheels adjacent said side portions, said side portions being folded over the wheels of said cart so that said wheels are received in said spacing, said spaced slots engaging with the hubs of said wheels.

4. A platen for stacking a toy shopping cart comprising a basket, handle means extending upwardly and rearwardly from said basket, and a plurality of wheels for rotatably supporting said basket on a supporting surface, said platen comprising:

a bottom wall; and means on said bottom wall for releasably engaging the wheels of said shopping cart said bottom wall including spaced slots in a rear edge thereof, said slots being operable for receiving the handlebars of a second shopping cart when said platen is received on top of the basket of a second shopping cart.

5. A stacking assembly for stacking a plurality of wheeled articles comprising:

a wheeled article including a plurality of wheels for rotatably supporting said wheeled article; and a platen including a bottom wall received adjacent to said plurality of wheels, and further including means on said bottom wall for releasably engaging said plurality of wheels.

6. The stacking assembly of claim 5 wherein said means on said bottom wall for releasably engaging said wheels comprises foldable flange portions joined to opposite sides of said bottom wall, said flange portions including an inner flange having slots therein for engaging with hubs of said wheels.

7. The stacking assembly of claim 5 wherein a bottom surface of said bottom wall is received on top of a second wheeled article, said bottom wall further including means for releasably engaging said second wheeled article.

8. A platen for stacking a wheeled article comprising:

a bottom wall; and foldable flange portions joined to opposite sides of said bottom wall, said flange portions including an inner flange having slots therein for slidably engaging with hubs of said wheels.

9. The platen of claim 8 wherein said bottom wall includes means for releasably engaging a second wheeled vehicle.

* * * * *